US012459774B2

(12) United States Patent
Crowley et al.

(10) Patent No.: US 12,459,774 B2
(45) Date of Patent: Nov. 4, 2025

(54) DISPENSER

(71) Applicant: Wrapex Limited, Bristol (GB)

(72) Inventors: Jonathan Crowley, Bristol (GB); Gary Badham, Bristol (GB)

(73) Assignee: Wrapex Limited, Bristol (GB)

( * ) Notice: Subject to any disclaimer, the term of this patent is extended or adjusted under 35 U.S.C. 154(b) by 193 days.

(21) Appl. No.: 18/478,139

(22) Filed: Sep. 29, 2023

(65) Prior Publication Data

US 2025/0108993 A1 Apr. 3, 2025

(30) Foreign Application Priority Data

Sep. 29, 2022 (GB) ..... 2214278

(51) Int. Cl.
*B65H 35/00* (2006.01)

(52) U.S. Cl.
CPC ..... *B65H 35/002* (2013.01); *B65H 35/0086* (2013.01); *B65H 2301/5151* (2013.01); *B65H 2301/5154* (2013.01)

(58) Field of Classification Search
CPC ..... Y10T 225/215; Y10T 225/216; B65H 35/0006; B65H 35/002; B65H 35/0086; B65H 35/006; B65H 35/04; B65H 35/06; B65H 2301/5151; B65H 2301/5154; B26D 7/14; B26D 7/22; A47K 10/32
USPC ..... 225/19, 20, 6, 51, 72–75; 83/649, 175
See application file for complete search history.

(56) References Cited

U.S. PATENT DOCUMENTS 833,470 A * 10/1906 Lipowsky ..... B65H 35/0006 83/175
2,663,369 A * 12/1953 Erhardt ..... B65H 35/0026 225/21
3,311,278 A * 3/1967 Brandon ..... B65H 35/0006 225/93
3,731,863 A * 5/1973 Nausedas ..... B65H 35/0006 225/85
3,991,923 A * 11/1976 Nishikawa ..... B65H 35/0026 225/21

(Continued)

FOREIGN PATENT DOCUMENTS

CN 207536892 U * 6/2018 ..... B65D 83/08
EP 0508021 A1 10/1992

(Continued)

OTHER PUBLICATIONS

English language translation of KR-20140125703-A to Sung.*

(Continued)

*Primary Examiner* — Evan H Macfarlane
(74) *Attorney, Agent, or Firm* — Vorys, Sater, Seymour and Pease LLP

(57) ABSTRACT

A dispenser includes a container for receiving a roll of material through an opening, a blade for cutting the material, a trap, a lock, a transfer element and a lid. The lid is moveable between a covered position, in which the lid covers the opening, and an uncovered position in which the lid does not cover the opening, and the lid is configured to engage with the transfer element such that movement from the uncovered position to the covered position moves the transfer element from an open position to a closed position to unlock the trap, and to permit movement of the trap to expose the blade for cutting the material.

20 Claims, 6 Drawing Sheets

(56) References Cited

U.S. PATENT DOCUMENTS

| | | | | | |
|---|---|---|---|---|---|
| 4,417,495 | A * | 11/1983 | Gordon | B26D 7/14 | 83/37 |
| 4,598,531 | A * | 7/1986 | Ruff | B65H 35/002 | 53/461 |
| 5,107,732 | A | 4/1992 | Hanmer | | |
| 5,146,828 | A * | 9/1992 | Huang | B65H 35/0006 | 83/649 |
| 6,725,753 | B2 * | 4/2004 | Bell | B26D 7/025 | 225/93 |
| 9,630,797 | B2 * | 4/2017 | Ferracane | B65H 35/002 | |
| 2004/0194601 | A1 * | 10/2004 | Lin | B65H 35/0006 | 225/38 |
| 2008/0190257 | A1 * | 8/2008 | Hanmer | B26F 3/02 | 83/649 |

FOREIGN PATENT DOCUMENTS

| | | | | | |
|---|---|---|---|---|---|
| EP | 1553035 | A1 | 7/2005 | | |
| FR | 2927070 | A1 * | 8/2009 | B26F 3/02 | |
| GB | 2466808 | A | 7/2010 | | |
| GB | 2530994 | A | 4/2016 | | |
| KR | 20140125703 | A * | 10/2014 | B65D 83/0882 | |
| WO | 2007095679 | A1 | 8/2007 | | |

OTHER PUBLICATIONS

English language translation of CN-207536892-U to Zheng.*
English language translation of FR-2927070-A1 to Lustman.*
European Search Report from corresponding EP Search Report from corresponding EP Application No. 23197213.4 mailed Mar. 20, 2024.
Combined Search and Examination Report from parent UK application No. GB2214278.0 mailed Mar. 28, 2023.

* cited by examiner

DISPENSER

FIELD OF THE DISCLOSURE

The present invention relates to a dispenser and a dispenser system.

BACKGROUND

Dispensers which are designed to dispense and cut material typically comprise a blade which may present a danger to a user. Users can be protected from the blade, for example, by shrouding the blade with moveable shrouds.

SUMMARY OF THE DISCLOSURE

According to a first aspect, there is provided a dispenser comprising: a container for receiving a roll of material through an opening; a blade for cutting the material, the blade at least partially disposed within the container; a trap extending along a length of the blade, the trap moveable between an extended position and a retracted position, wherein the trap is configured to obscure the blade in the extended position, and to expose the blade in the retracted position to permit cutting of the material by the blade. The trap is biased to the extended position. The dispenser comprises a lock moveable between a locked position and an unlocked position, wherein the lock is configured to prevent movement of the trap from the extended position to the retracted position in the locked position, and to permit movement of the trap from the extended position to the retracted position when in the unlocked position; and a transfer element moveable between an open position and a closed position, and biased to the open position. The transfer element is configured to engage with the lock such that, when the transfer element is in the open position the lock is in the locked position, and when the transfer element is moved to the closed position, the lock is moved to the unlocked position. The dispenser comprises a lid moveable between a covered position, in which the lid covers the opening, and an uncovered position in which the lid does not cover the opening, wherein the lid is configured to engage with the transfer element such that movement from the uncovered position to the covered position moves the transfer element from the open position to the closed position to unlock the trap, and permit movement of the trap to expose the blade for cutting the material.

Locking movement of the traps away from the extended position until the lid covers the opening of the container improves the safety of the dispenser, by ensuring that the blade is covered until the lid is closed in the covered position. The lid may be coupled to the container, for example, the lid may be coupled with a hinge at an edge of the opening of the container.

It may be that the dispenser comprises a pair of traps extending along opposing sides of the blade, wherein the lid comprises a jaw which is configured to engage with the pair of traps to trap the material between the jaw and the traps when the lid is in the covered position. It may be that the jaw comprises two opposing protrusions, each of which abuts a respective trap, of the pair traps, to move the traps from the extended position to the retracted position when the lid is moved from the uncovered position to the covered position. It may be that each of the protrusions of the jaw abuts the respective traps at, or after, the point that the lock has been moved to the unlocked position by movement of the lid towards the covered position.

It may be that when the lid is moved from the uncovered position to the covered position, the jaw is configured to contact the material, extending from the roll out of the container, before the transfer element is moved away from the open position to the closed position.

It may be that the transfer element comprises a pinch. It may be that the lid comprises a lid cam which is configured to cooperate with the pinch to hold the material therebetween as the lid moves from the uncovered position to the covered position. The pinch is therefore used both as a mechanism to hold the material during movement of the lid, as well as mechanism to release the lock to permit movement of the trap(s) away from the blade, to expose the blade when the lid is in the covered position, thus using space more efficiently in the dispenser. The lid cam may be separately moveable from a lid cover to allow easier assembly and cleaning of the lid, and simpler manufacture of the lid cover.

It may be that the pinch is moveable from the open position to the closed position on abutment with the lid cam as the lid is moved from the uncovered position to the covered position.

It may be that the lock comprises a cam slot and the transfer element comprises a pin received in the cam slot such that movement of the transfer element from the open position to the closed position forces movement of the lock by engagement of the pin with the cam slot.

It may be that the lock comprises a slit and an adjacent block wherein the slit is configured to receive the trap in the retracted position when the lock is in the unlocked position, and the block is configured to obstruct movement of the trap from the extended position to the retracted position.

The lock may comprise a pair of slits and a pair of blocks, at least one block disposed between the pair of slits, wherein the pair of slits are configured to receive respective traps in the retracted position when the lock is in the unlocked position, and the pair of blocks are configured to obstruct movement of respective traps from the extended position to the retracted position. Having a pair of slits which are separated by a block is a space efficient way of locking and unlocking the traps to obstruct and permit movement of the traps to the retracted position, and requires little movement of the lock between the locked position and the unlocked position.

It may be that the trap comprises a lug extending from the end of the trap, wherein the slit is configured to receive the lug at the end of the trap. It may be that the pair of traps each comprise a lug extending from each end of the respective trap, wherein the pair of slits are configured to receive the lugs at respective ends of the traps.

It may be that the transfer element is linearly moveable between the open position and the closed position. Linear movement of the transfer element between the open position and the closed position, instead of for example rotary movement, is the most efficient travel of the transfer element to achieve a required throw (i.e., movement of the lock).

It may be that the transfer element and/or the lock is composed of POM homopolymer or copolymer, at least where the respective transfer element and lock come into sliding contact with any other part throughout its travel. POM homopolymer or copolymer are a low friction material which permit sliding movement with low resistance and wear.

It may be that the pair of traps are composed of ASA or ABS plastics. ASA and ABS plastics are high strength and rigidity plastics which enable the traps to be rigid enough along their entire length to obscure the blade along its entire length.

According to a second aspect, there is provided a dispenser system comprising: a dispenser according to the first aspect; and a roll of material for insertion into the container of the dispenser.

The skilled person will appreciate that except where mutually exclusive, a feature or parameter described in relation to any one of the above aspects may be applied to any other aspect. Furthermore, except where mutually exclusive, any feature or parameter described herein may be applied to any aspect and/or combined with any other feature or parameter described herein.

BRIEF DESCRIPTION OF THE DRAWINGS

Embodiments will now be described, by way of example only, with reference to the accompanying Figures, in which.

DETAILED DESCRIPTION

Figure 1:
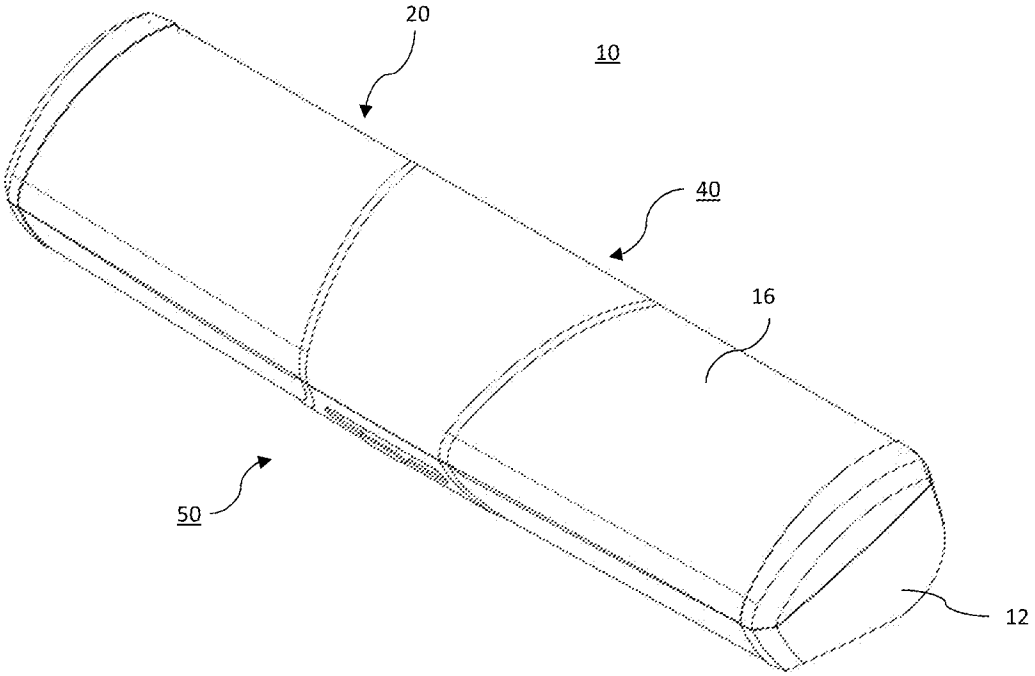
FIG. 1 schematically shows an oblique view of a dispenser system in a cutting configuration.
Figure 2:
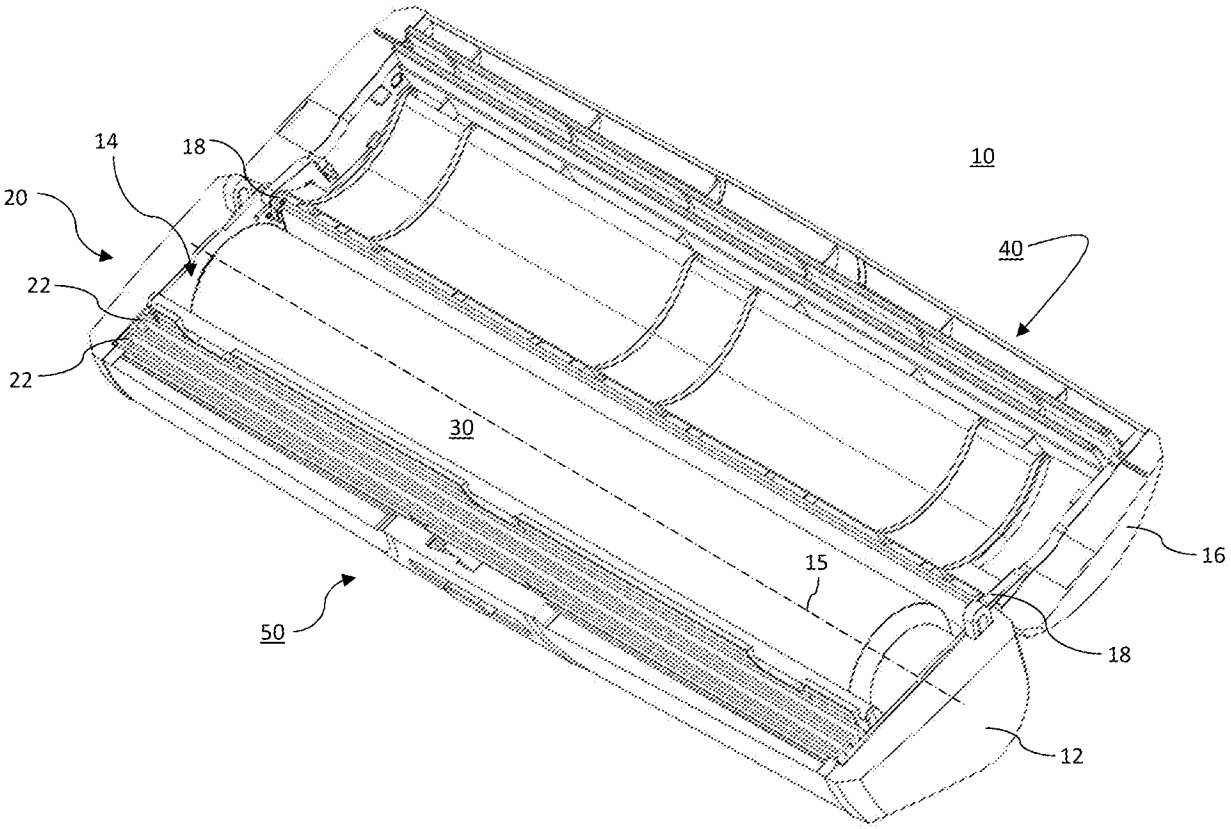
FIG. 2 schematically shows an oblique view of the dispenser system in a dispensing configuration.
Figure 3:
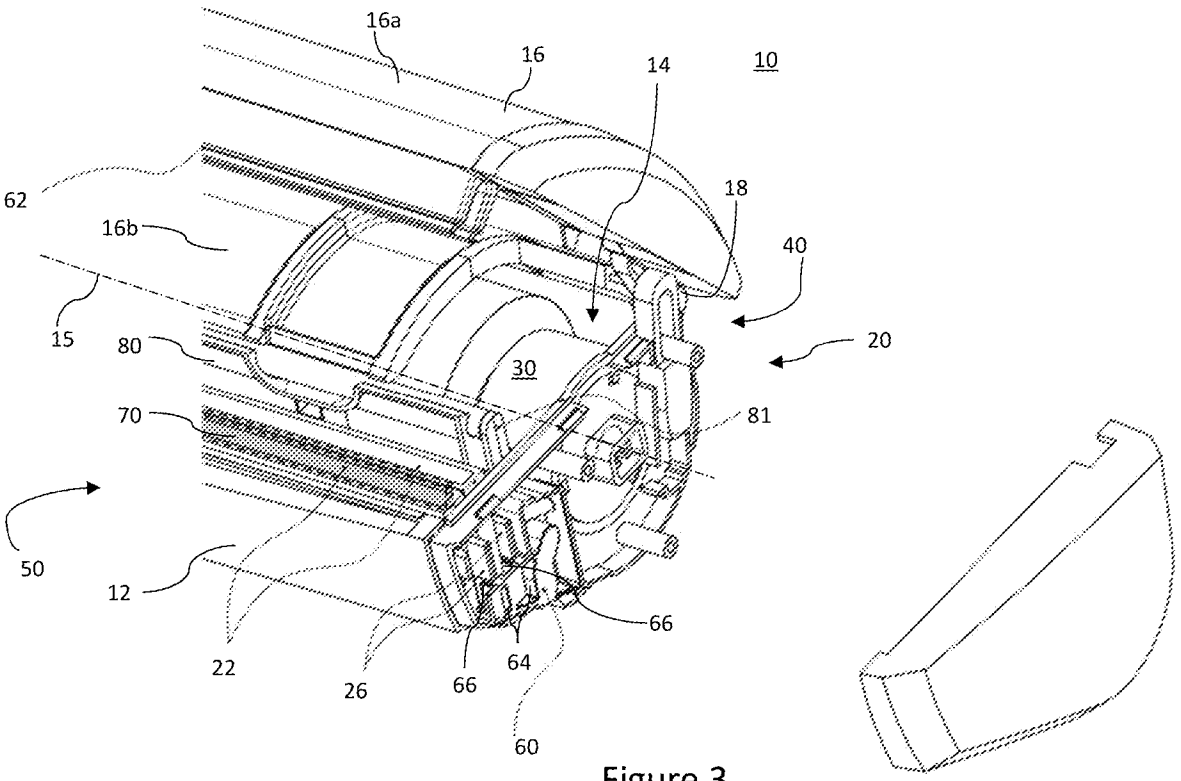
FIG. 3 schematically shows an oblique exploded view of an end of the dispenser system in the dispensing configuration.

FIGS. 1-3 show a dispenser system 10 comprising a dispenser 20 and a roll of material 30. The dispenser 20 comprises a container 12 and a lid 16. The container 12 comprises an opening 14 and is configured to receive the roll of material 30 through the opening 14. FIGS. 2 and 3 show the roll of material 30 disposed within the container 12. The roll of material 30 is configured to rotate within the container 12 along an elongate axis 15 along which the roll of material 30 extends.

The roll of material 30 may be supported in the container 12 on opposing ends of the roll of material 30, so that the roll of material 30 can spin on its elongate axis 15 to dispense material. Alternatively, the roll of material 30 may be supported by a shaft which extends through a central hole of the roll of material 30. It will be appreciated that there are many suitable ways in which the roll of material 30 may be supported within the container 12 to enable the roll to dispense material out of the container 12. The roll of material may include, for example, a roll of aluminium foil, plastic film, paper, food grade materials, or any suitable planar material which can be dispensed.

The lid 16 is configured to cover the opening 14 of the container. The lid 16 is moveable between a covered position (FIG. 1), in which it covers the opening 14, and an uncovered position (FIGS. 2 and 3), in which the lid 16 does not cover the opening 14. When the lid 16 is in the covered position, the dispenser 20 and the dispenser system 10 are in the cutting configuration, as shown in FIG. 1. When the lids 16 is in the uncovered position, the dispenser 20 and the dispenser system 10 are in the dispensing configuration, as shown in FIG. 2.

In this example, the lid 16 is coupled to the container 12 with a hinged connection 18 (best shown in FIG. 2). The hinged connection 18 in this example is disposed at a back end 40 of the dispenser 20. In some examples, the lid may be coupled to the container in any suitable manner. In other examples, the lid may not be coupled to the container.

The dispenser 20 further comprises a blade 70 (shown shaded and bounded by dotted lines in FIG. 3), which is configured for cutting the material. The blade 70 is at least partially disposed within the container. In this example, the blade 70 extends along an axis parallel to the elongate axis 15, and adjacent to the roll of material 30, at a front end 50 of the dispenser 20, so that the blade is closer to the front end 50 than the roll of material 30. Material may be dispensed from the roll of material 30, towards the front end 50 of the dispenser 20 where it can meet the blade 70, and be cut at the blade 70 from the roll of material 30. It will be appreciated that the blade may be closer to the back end of the dispenser than the roll of material, and that dispensed material may be dispensed through the hinged joint of the dispenser.

Extending along opposing sides of the blade 70, the dispenser 20 comprises a pair of traps 22, in this example. The traps 22 are configured to obscure the blade 70 between them so as to protect a user from the blade 70 in use. The traps 22 are configured to move between an extended position, in which they extend out of the container 12 beyond the blade 70 to obscure the blade 70, so that it cannot cut anything (shown in FIG. 2), to a retracted position, in which they are retracted into the container 12 to expose the blade 70 to thereby permit the blade 70 to cut the material. In this example, the traps 22 are adjacent to, and in contact with, the blade 70, and the traps 22 are linearly slidable along a depth of the blade 70 into and out of the container 12, between the retracted position and the extended position. In some examples, there may be only a single trap which may not be in contact with the blade, and may, for example, form a cover over the blade when in the extended position. The traps 22 may be moveable in any suitable manner, such as by rotation or linearly away from the blade.

In this example, the traps 22 are biased towards the extended position, so that the blade 70 is always obscured unless an external force counteracts the biasing force on the traps 22 to expose the blade 70. This improves safety for the user. In this example, the traps 22 are also locked in the extended position, so that the blade 70 is obscured unless the traps 22 are simultaneously unlocked and an external force is applied counteracting the biasing force on the traps 22, to move them from the extended position to the retracted position. This further improves safety for the user.

In this example, the traps 22 each comprise an elongate recess along the length of the respective trap 22, which are configured to receive a jaw 62 extending from the lid 16. In this example, each recess is configured to receive one of a pair of opposing protrusions of the jaw 62. When the lid 16 is moved, by an external force, to the covered position, from the uncovered position, the protrusions of the jaw 62 trap material dispensed from the roll of material 30 between the jaw 62 and the traps 22 and push the material into the recesses of the traps 22 to pull the material taut over the blade 70 to aid in cutting the material. The protrusions of the jaw 62 may comprise a high friction material to aid in trapping the material between the jaw 62 and the traps 22, and to aid in pushing the material into the recesses of the traps 22.

The dispenser 20 comprises a lock 60 which is configured to lock the traps 22 in the extended position. The lock 60 is moveable between a locked position and an unlocked position. In the locked position, the lock 60 is configured to prevent movement of the pair of traps 22 from the extended position to the retracted position, to prevent inadvertent exposure of the blade 70. In the unlocked position, the lock 60 is configured to permit movement of the traps 22 from the extended position to the retracted position.

In this example, the traps 22 comprise lugs 26 (best seen in FIG. 3), with each lug 26 extending from each end of a respective trap 22 (only one end is shown in FIG. 3). The lugs 26 are configured to interact with the lock 60 in the locked position to obstruct movement of the traps 22 from the extended position to the retracted position.

In this example, the lock 60 comprises a pair of slits 64 and a pair of blocks 66, with blocks 66 and slits 64 alternating, such that one block 66 is between the pair of slits 64. The pair of blocks 66 are each configured to obstruct a respective lug 26 when the traps 22 are moved towards the retracted position, when the lock 60 is in the locked position. The lock 60 is configured to move, into the unlocked position, in which the lugs 26 can be received in the slits 64 when the traps 22 are moved to the retracted position, thereby exposing the blade 70 for cutting the material.

In this example, the lock 60 is biased towards the locked position so that, in the absence of an external force moving the lock to the unlocked position, the lock 60 obstructs movement of the traps 22 from the extended position to the retracted position. This improves the safety for a user yet further.

FIG. 3 shows the lock 60 at only one end of the dispenser 20, however, it will be appreciated that the lock 60 may also be positioned at the other end of the dispenser 20 and may interact with the other end of the traps 22 in a similar manner as described above, so that when an external force is applied to the traps 22 to move them towards the retracted position, the traps 22 may be prevented from moving on both ends of the traps 22. The traps 22 may thus be represented as a simply supported beam when the lock 60 is in the locked position, and the traps 22 are in the extended position. It will be appreciated that, dependent on the stiffness of the material of the traps 22, the beam may deflect upon application of an external force in the centre of the traps 22. A material of the traps 22 may be selected to have a high stiffness to resist such deflection. For example, the traps 22 may be composed of ASA or ABS plastics, which have high strength and rigidity.

The length of the traps 22 may be limited to limit the expected deflection in the centre of the traps 22 if a suitable force is applied to the centre of the traps 22 while the lock 60 is in the locked position. Alternatively, an additional lock 60 may be positioned in the centre of the traps 22 to provide another point of support, thus effectively halving the unsupported beam length. In some examples, a lock may extend along the length of the traps. In yet further examples, the extended position of the traps 22 above the blade 70 may be dictated by the expected possible deflection of the traps 22, to reduce the likelihood that a high enough force could be applied and accidentally expose some of the blade 70.

In other examples, there may be no lugs on ends of the traps, and instead the lock may simply interact with the ends of the traps themselves, or in the middle of the traps, or along a partial or entire elongate extent of the traps. It will be appreciated that there are many suitable ways of obstructing movement of the traps to the retracted position.

When the lid 16 is moved towards the covered position, the protrusions of the jaw 62 eventually come into contact with a base of the recesses in the traps 22, and further movement of the lid 16 towards the covered position imparts a force to the traps 22, via the jaw 62, to push the traps 22 from the extended position to the retracted position, thereby exposing the blade 70 (when the lock 60 is in the unlocked position) only when the lid 16 is in the covered position, such that the lid 16 now covers the blade 70. The trapped material is thereby held taut and passed over the blade 70 and cut by the blade 70.

In this example, the lid 16 comprises a lid cover 16*a* and a lid cam 16*b*. The lid cover 16*a* is configured to cover the opening 14 of the container 12, while the lid cam 16*b* is separately moveable to the lid cover 16*a*. In other examples, the lid cam may be integral with the lid cover to form a unitary lid. Having a separate lid cover 16*a* and lid cam 16*b* simplifies manufacturing of the lid 16.

In this example, the dispenser 20 comprises a transfer element 80 which is moveable between an open position and a closed position. The transfer element 80 is configured to engage with the lock 60 so that, when the transfer element 80 is in the open position, the lock 60 is in the locked position, and when the transfer element 80 is moved to the closed position, the lock 60 is moved to the unlocked position. Therefore, in this example, the transfer element 80 is configured to transfer movement of the lid 16 to movement of the lock 60.

In this example, the transfer element 80 is biased towards the open position, thereby biasing the lock 60 to the locked position. The transfer element 80 in this example comprises a pinch 81 which is configured to engage with the lid cam 16*b*. The pinch 81 in this example is moveable from the open position to the closed position on abutment with the lid cam 16*b* as the lid 16 is moved towards the covered position, so that movement of the lid 16 from the uncovered position to the covered position forces the lid cam 16*b* against the pinch 81, and pushes the transfer element 80 from the open position to the closed position, thus forcing the lock 60 to move from the locked position to the unlocked position. On further movement of the lid 16 towards the covered position, the traps 22 are pushed towards the retracted position, and because the movement of the lid 16 moving the transfer element 80 has already pushed the lock 60 to the unlocked position, the traps 22 are permitted to move to the retracted position, thereby exposing the blade 70 and forcing material, from the roll of material 30, which is trapped between the traps 22 and the jaw 62 onto the blade to cut the material.

The pinch 81 in this example is also configured to cooperate with the lid cam 16*b* to hold the material between the pinch 81 and the lid cam 16*b* as the lid 16 moves from the uncovered position to the covered position, and back to the uncovered position. The pinch 81 is therefore used both as a mechanism to hold the material during movement of the lid 16, as well as mechanism to release the lock 60 to permit movement of the traps 22 away from the blade 70, to expose the blade 70 to the material when the lid 16 is in the covered position, thus using space more efficiently in the dispenser 20.

Having the lid cam 16*b* separately moveable from the lid cover 16*a* allows the pinch to cooperate with the lid cam 16*b* irrespective of the position of the lid cover 16*a* (and therefore the jaw 62), so that the material can be held in place at all times. It also allows easier assembly and cleaning of the lid 16, and simpler manufacture of the lid cover 16*a*.

This arrangement ensures that the traps 22 are locked to the extended position until the lid 16 covers the opening 14, such that the blade 70 is only exposed once the lid 16 covers the blade 70. This reduces the likelihood of the blade 70 being accidentally exposed to a user in use, by only exposing the blade 70 to the material when the blade 70 is otherwise covered by the lid 16.

Figure 4:
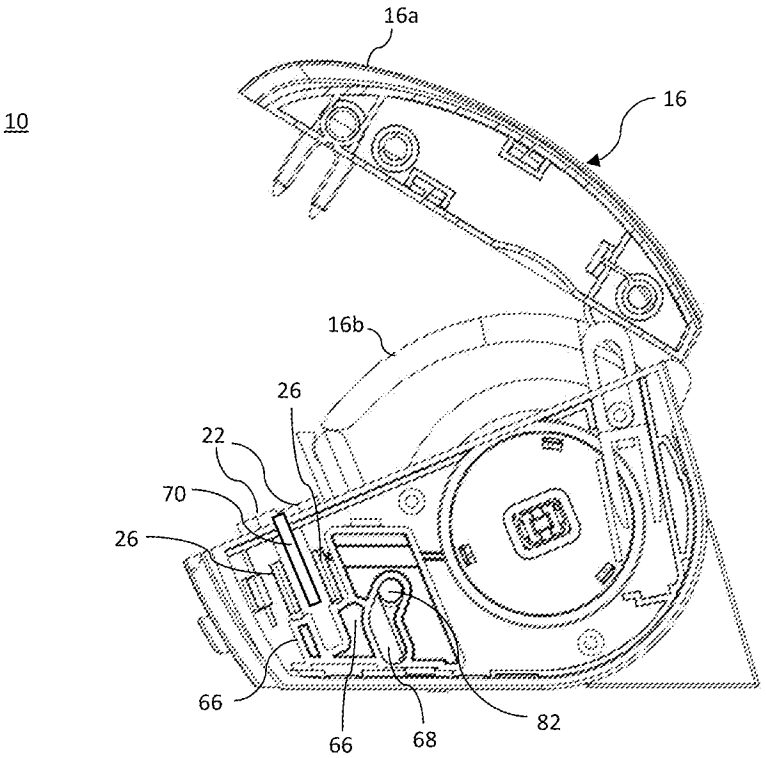
FIG. 4 schematically shows a cross-sectional view of the dispenser system in the dispensing configuration.
Figure 5:
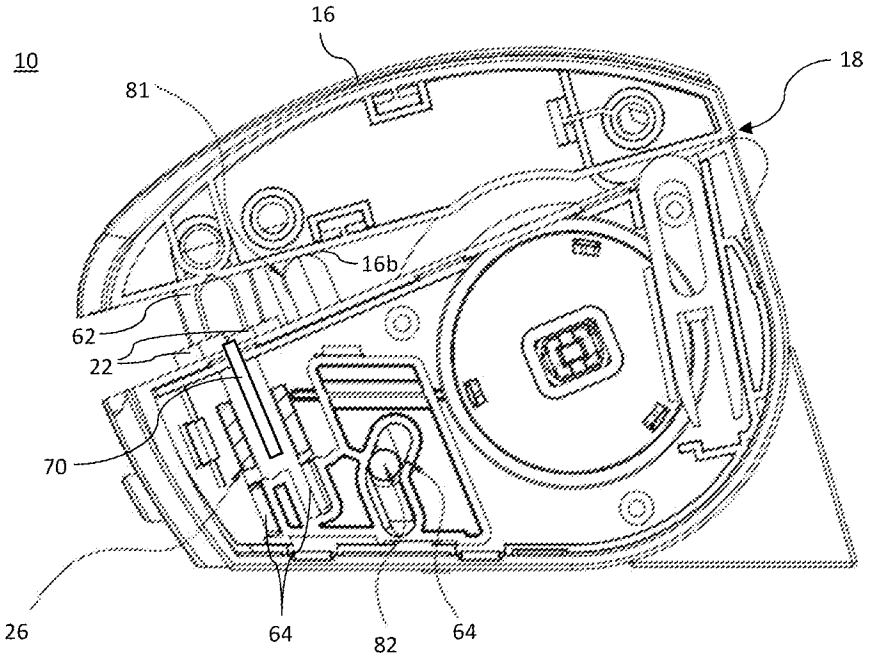
FIG. 5 schematically shows a cross-sectional view of the dispenser system in an intermediate configuration between the dispensing configuration and the cutting configuration.
Figure 6:
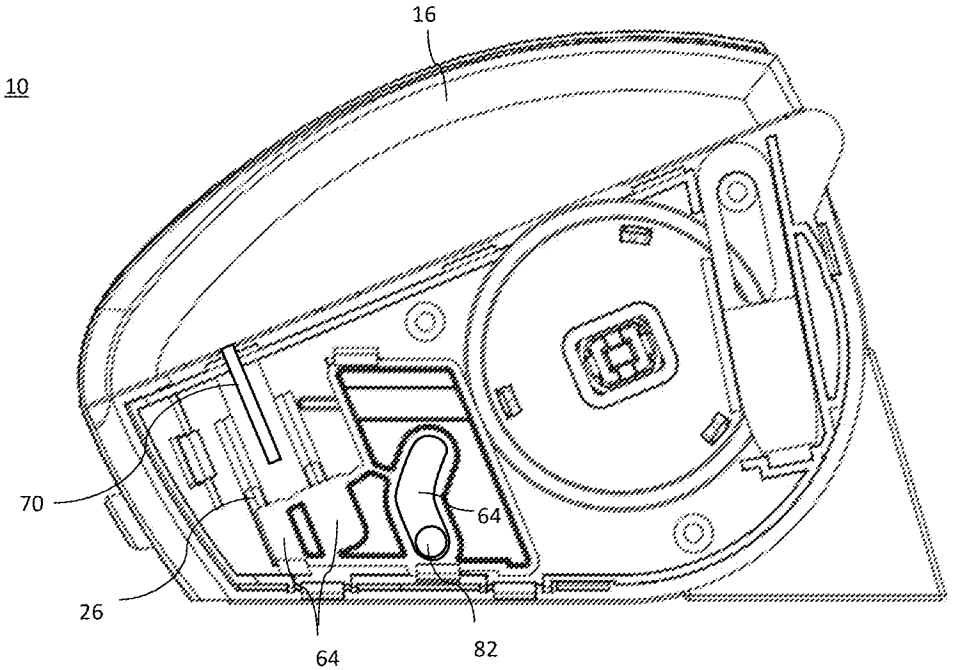
FIG. 6 schematically shows a cross-sectional view of the dispenser system in the cutting configuration.

FIGS. 4-6 show cross-sectional views of the dispenser system 10 in a dispensing configuration, an intermediate configuration and a cutting configuration respectively. The configurations correspond, respectively, to movement of the lid 16 from the uncovered position to and intermediate position and then to the covered position. FIG. 4-6 show how the transfer element 80 transfers movement of the lid 16 from the uncovered position to the covered position, to movement of the lock 60 form the locked position to the unlocked position to permit movement of the traps 22.

In FIG. 4, it can be seen that the lugs 26 of the traps are obstructed by the blocks 66 of the lock 60, as the lock 60 is in the locked position.

The transfer element 80 comprises a pin 82 and the lock 60 comprises a cam slot 68. The pin 82 is received in the cam slot 68 so that movement of the transfer element 80 from the open position to the closed position forces movement of the lock 60 by engagement of the pin 82 with the cam slot 68.

In this example, the transfer element 80 in linearly moveable between the open and closed position, and the linear movement of the transfer element 80 translates to linear movement of the lock 60. Linear movement of the transfer element 80 is the most efficient travel of the transfer element 80 to achieve a required throw (i.e., movement of the lock 60). In other examples, the transfer element 80 may undergo rotational movement, or any suitable movement which can be translated into movement of the lock from the locked position to the unlocked position.

The transfer element 80 and/or the lock 60 may be composed of POM homopolymer or copolymer, at least at the pin 82 and the cam slot 68, where they come into sliding contact with one another. POM homopolymer or copolymer are a low friction material which permit sliding movement with low resistance and wear.

In FIG. 5, it can be seen that the lid 16 has been moved towards the covered position about its hinged joint 18. In this example, when the lid 16 is moved from the uncovered position towards the covered position, the jaw 62 is configured to contact material, extending from the roll of material 30 out of the container 12, before the transfer element 80 is moved away from the open position to the closed position. This helps to keep the material taut before parts of the dispenser 20 are moved.

In FIG. 5, it can be seen that the lid cam 16*b* is engaged with the pinch 81 so that material is held between the pinch 81 and the lid cam 16*b*, and the pinch 81 has been forced away from the open position, towards the closed position, into the intermediate position via a linear pathway.

In the intermediate position shown in FIG. 5, the pin 82 has moved partially down the cam slot 68, which has forced the lock 60 to move towards the unlocked position, since a first section of the cam slot 68 is angled with respect to the linear pathway of the pin 82. In the unlocked position, the slits 64 of the lock 60 are aligned with the lugs 26 of the traps 22, to permit movement of the traps 22 towards the retracted position.

At this point, the jaw 62 of the lid 16 is received within the traps 22, but not yet abutting the bases of the recesses in the traps 22. Therefore, each of the protrusions of the jaw 62 abuts the respective traps 22 after the point that the lock 60 has been moved to the unlocked position by movement of the lid 16 towards the covered position. This means that, once the jaw 62 comes into contact with the traps 22, the traps 22 will be able to move to the retracted position, since they will no longer be locked in the extended position. It will be appreciated that the protrusions of the jaw 62 may abut the respective traps 22 at, or just before, the point that the lock 60 has been moved to the unlocked position.

Having a pair of slits 64 which are separated by a block 66 is a space efficient way of locking and unlocking the traps 22 to obstruct and permit movement of the traps 22 to the retracted position, and requires little movement of the lock 60 between the locked position and the unlocked position to achieve the locking/unlocking function.

As the dispenser system 10 is moved towards the cutting configuration, the lid 16 is pushed further down towards the covered position, as shown in FIG. 6, in which the pin 82 abuts an end of the cam slot 68, and which in the traps 22 are pushed to the retracted position such that they are received within the slits 64. A second section of the cam slot 68 is parallel to the linear pathway of the transfer element 80 from the open position to the closed position, such that any further movement of the pin 82 through the cam slot 68 does not move the lock 60 away from the unlocked position.

It will be understood that the invention is not limited to the embodiments above-described and various modifications and improvements can be made without departing from the concepts described herein. Except where mutually exclusive, any of the features may be employed separately or in combination with any other features and the disclosure extends to and includes all combinations and sub-combinations of one or more features described herein.

What is claimed is:

1. A dispenser comprising:

a container for receiving a roll of material through an opening;

a blade for cutting the material, the blade at least partially disposed within the container;

a trap extending along a length of the blade, the trap moveable between an extended position and a retracted position, wherein the trap is configured to obscure the blade in the extended position, and to expose the blade in the retracted position to permit cutting of the material by the blade;

a lock moveable between a locked position and an unlocked position, wherein the lock is configured to prevent movement of the trap from the extended position to the retracted position in the locked position, and to permit movement of the trap from the extended position to the retracted position when in the unlocked position; and a transfer element moveable between an open position and a closed position, wherein the transfer element is configured to engage with the lock such that, when the transfer element is in the open position the lock is in the locked position, and when the transfer element is moved to the closed position, the lock is moved to the unlocked position;

a lid moveable between a covered position, in which the lid covers the opening, and an uncovered position in which the lid does not cover the opening, wherein the lid is configured to engage with the transfer element such that movement of the lid from the uncovered position to the covered position moves the transfer element from the open position to the closed position to unlock the trap, and permit movement of the trap to expose the blade for cutting the material, and wherein the lid is configured to engage the trap such that movement of the lid from the uncovered position toward the covered position moves the trap from the extended position toward the retracted position.

2. A dispenser according to claim 1, wherein the trap comprises a first trap, wherein the dispenser further comprises a second trap moveable between an extended position and a retracted position, wherein the first and second traps extend along opposing sides of the blade, wherein the lid comprises a jaw which is configured to engage with the first and second traps to trap the material between the jaw and the traps when the lid is in the covered position.

3. A dispenser according to claim 2, wherein the jaw comprises two opposing protrusions, each of which abuts a respective trap of the first and second traps to move the traps from the extended positions to the retracted positions when the lid is moved from the uncovered position to the covered position.

4. A dispenser according to claim 3, wherein each of the protrusions of the jaw abuts the respective traps at, or after, the point that the lock has been moved to the unlocked position by movement of the lid towards the covered position.

5. A dispenser according to claim 3, wherein when the lid is moved from the uncovered position to the covered position, the jaw is configured to contact the material, extending from the roll out of the container, before the transfer element is moved away from the open position to the closed position.

6. A dispenser according to claim 1, wherein the transfer element comprises a pinch, and wherein the lid comprises a lid cam which is configured to cooperate with the pinch to hold the material therebetween as the lid moves from the uncovered position to the covered position.

7. A dispenser according to claim 6, wherein the pinch is moveable from the open position to the closed position on abutment with the lid cam as the lid is moved from the uncovered position to the covered position.

8. A dispenser according to claim 1, wherein the lock comprises a cam slot and the transfer element comprises a pin received in the cam slot such that movement of the transfer element from the open position to the closed position forces movement of the lock by engagement of the pin with the cam slot.

9. A dispenser according to claim 1, wherein the lock comprises a slit and an adjacent block wherein the slit is configured to receive the trap in the retracted position when the lock is in the unlocked position, and the block is configured to obstruct movement of the trap from the extended position to the retracted position.

10. A dispenser according to claim 9, wherein the trap comprises a lug extending from an end of the trap, wherein the slit is configured to receive the lug at the end of the trap.

11. A dispenser according to claim 1, wherein the transfer element is linearly moveable between the open position and the closed position.

12. A dispenser according to claim 1, wherein the transfer element and/or the lock is composed of a POM homopolymer or copolymer, at least where the respective transfer element and/or lock comes into sliding contact with any other part throughout movement of the respective transfer element and/or lock.

13. A dispenser according to claim 1, wherein the trap is composed of an ASA plastic or an ABS plastic.

14. A dispenser system comprising:

a dispenser comprising:

a container for receiving a roll of material through an opening;

a blade for cutting the material, the blade at least partially disposed within the container;

a trap extending along a length of the blade, the trap moveable between an extended position and a retracted position, wherein the trap is configured to obscure the blade in the extended position, and to expose the blade in the retracted position to permit cutting of the material by the blade;

a lock moveable between a locked position and an unlocked position, wherein the lock is configured to prevent movement of the trap from the extended position to the retracted position in the locked position, and to permit movement of the trap from the extended position to the retracted position when in the unlocked position; and a transfer element moveable between an open position and a closed position, wherein the transfer element is configured to engage with the lock such that, when the transfer element is in the open position the lock is in the locked position, and when the transfer element is moved to the closed position, the lock is moved to the unlocked position;

a lid moveable between a covered position, in which the lid covers the opening, and an uncovered position in which the lid does not cover the opening, wherein the lid is configured to engage with the transfer element such that movement from the uncovered position to the covered position moves the transfer element from the open position to the closed position to unlock the trap, and permit movement of the trap to expose the blade for cutting the material, wherein the lid is configured to engage the trap such that movement of the lid from the uncovered position toward the covered position moves the trap from the extended position toward the retracted position; and a roll of material for insertion into the container of the dispenser.

15. A dispenser system according to claim 14, wherein the trap comprises a first trap, wherein the dispenser system further comprises a second trap moveable between an extended position and a retracted position, wherein the first and second traps extend along opposing sides of the blade, wherein the lid comprises a jaw which is configured to engage with the first and second traps to trap the material between the jaw and the traps when the lid is in the covered position.

16. A dispenser according to claim 15, wherein the jaw comprises two opposing protrusions, each of which abuts a respective trap of the first and second traps to move the traps from the extended positions to the retracted positions when the lid is moved from the uncovered position to the covered position.

17. A dispenser according to claim 16, wherein each of the protrusions of the jaw abuts the respective traps at, or after, the point that the lock has been moved to the unlocked position by movement of the lid towards the covered position.

18. A dispenser according to claim 16, wherein when the lid is moved from the uncovered position to the covered position, the jaw is configured to contact the material, extending from the roll out of the container, before the transfer element is moved away from the open position to the closed position.

19. A dispenser according to claim 14, wherein the transfer element comprises a pinch, and wherein the lid comprises a lid cam which is configured to cooperate with the pinch to hold the material therebetween as the lid moves from the uncovered position to the covered position.

20. A dispenser according to claim 19, wherein the pinch is moveable from the open position to the closed position on abutment with the lid cam as the lid is moved from the uncovered position to the covered position.

* * * * *